US006279962B1

(12) United States Patent
McGarian et al.

(10) Patent No.: US 6,279,962 B1
(45) **Date of Patent: *Aug. 28, 2001**

(54) SAFETY JOINT

(75) Inventors: Bruce McGarian; Valentine H. McGarian, both of Aberdeen (GB)

(73) Assignee: Smith International, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/269,032

(22) PCT Filed: Sep. 25, 1997

(86) PCT No.: PCT/GB97/02611

§ 371 Date: Mar. 18, 1999

§ 102(e) Date: Mar. 18, 1999

(87) PCT Pub. No.: WO98/13576

PCT Pub. Date: Apr. 2, 1998

(30) Foreign Application Priority Data

Sep. 27, 1996 (GB) ..... 9620238

(51) Int. Cl.[7] ..... F16L 25/00

(52) U.S. Cl. ..... 285/12; 285/18; 285/39; 285/307; 285/316; 285/330; 285/922; 175/320

(58) Field of Search ..... 285/1, 12, 18, 285/39, 307, 330, 316, 922; 175/106, 320

(56) References Cited

U.S. PATENT DOCUMENTS

| | | | | |
|---|---|---|---|---|
| 2,049,289 | * | 7/1936 | Burns et al. | 285/922 |
| 2,049,290 | * | 7/1936 | Burns et al. | 285/922 |
| 2,163,212 | * | 6/1939 | Reddick | 285/922 |
| 2,307,275 | | 1/1943 | Johnson . | |
| 2,736,384 | * | 2/1956 | Potts . | |
| 3,842,914 | | 10/1974 | Mott . | |
| 4,728,124 | | 3/1988 | Righi et al. . | |

FOREIGN PATENT DOCUMENTS

| | | |
|---|---|---|
| 0238915 | 9/1987 | (EP) . |
| 538666 | 8/1941 | (GB) . |
| 2294068 | 4/1996 | (GB) . |

* cited by examiner

*Primary Examiner*—Teri Pham Luu
(74) *Attorney, Agent, or Firm*—Dykema Gossett PLLC

(57) ABSTRACT

The present invention relates to safety joints which permit separation of a downhole assembly at the location of the joint. The invention provides a safety joint characterized by the provision of auxiliary interconnecting means on a body (2) for interconnecting said body (2) to an auxiliary shaft after removal of a main shaft (3) from said body (2). Axial loading between the auxiliary shaft and said body (2) may be thereby transferred. Furthermore, torque may also be transferred between the auxiliary shaft and said body (2) in a direction opposite to that in which torque may be transferred from the main shaft (3) to said body (2). Thus, the present invention allows a length of downhole assembly located above said body (2) to be removed from a wellbore by rotation of said length of assembly in a first direction and then allows rotation of said body (2) in the same first direction by means of the auxiliary shaft in an attempt to remove a length of assembly stuck in the wellbore downhole of said body (2).

21 Claims, 5 Drawing Sheets

SAFETY JOINT

This invention relates to a safety joint for use in a downhole assembly to permit separation of the assembly at the location of the joint.

Safety joints are well known in the oil and gas industries as a means of providing a point of separation of a downhole assembly. Typically, a safety joint may be used in a fishing string, a washover string or as part of a drill string to enable the majority of the string to be recovered should operative components at the bottom of the string become stuck.

In order to perform the required function a safety joint must be capable of transmitting axial loading both in the tension and compression directions of the joint, and must be capable of transmitting a high level of torque from the upper part of the joint to the lower part of the joint in the normal rotational direction of the string to which it is connected. Typically, in order to allow separation of the string at the safety joint the safety joint incorporates two major components which are connected together by a screw thread which can be released by reverse rotation of the string. The screw threaded connection is designed to unscrew at a torque significantly less than that required to unscrew the connections above it in the string with a result that reverse rotation of the string will cause separation of the string at the safety joint thereby allowing the portion of the string located above the safety joint to be recovered.

A known design of safety joint for use in a downhole assembly to permit separation of the assembly at the location of the joint comprises a body, means for securing the body to part of the assembly, a main shaft, means for securing the main shaft to the remainder of the assembly, and main interconnecting means for interconnecting the main shaft and the body to transfer axial loading therebetween and to transmit torque from the shaft to the body in one direction of rotation of the shaft, the interconnecting means being releasable in response to rotation of the shaft in the opposite direction of rotation to release the shaft from the body.

The present invention is characterized in that auxiliary interconnecting means are provided on the body for interconnecting the body to an auxiliary shaft, after removal of the main shaft from the body, to transfer axial loading between the auxiliary shaft and the body and to transfer torque from the auxiliary shaft to the body in the said opposite direction of rotation.

The present invention enables the safety joint to be operated in conventional manner to release the upper part of a downhole assembly which has become stuck below the safety joint. An auxiliary shaft can then be run into the hole on a suitable string for connection to the body to enable a torque to be applied to the body and thus to the stuck part of the assembly in a direction opposite to the direction of rotation to which the assembly was subject when it became stuck. The application of such reverse torque will, in certain instances, be effective to release the stuck portion of the assembly. Even if the reverse torque does not free the entire stuck assembly, it will result in separation of the stuck part of the assembly from the safety joint body, thereby allowing the safety joint body to be recovered. In fact, separation may occur at a pin joint some distance below the safety joint body with the result that not only the safety joint body, but also part of the stuck assembly may be recovered.

In a particularly preferred embodiment of the invention the auxiliary interconnecting means is releasable in response to rotation of the auxiliary shaft in the said one direction of rotation. Accordingly, if the application of a reverse torque does not free the stuck assembly nor separates the safety joint body from the stuck assembly, the auxiliary shaft and the components upon which it is mounted can be recovered from the hole.

In a particularly preferred embodiment of the invention the main interconnecting means comprises a first screw thread on the body for engagement by a corresponding screw thread on the main shaft and a main dog clutch for transmitting torque in the one direction of rotation from the main shaft to the body. Preferably, the auxiliary interconnecting means comprises a second screw thread on the body for engaging a corresponding screw thread on the auxiliary shaft, and an auxiliary dog clutch for transmitting torque from the auxiliary shaft to the body in the said opposite direction of rotation. Preferably, the main dog clutch is formed by dog teeth provided on the body and dog teeth provided on a collar secured to the main shaft. Preferably, the auxiliary dog clutch is formed by the dog teeth provided on the body and dog teeth provided on an auxiliary collar secured to the auxiliary shaft.

Preferably, the dog teeth provided on the collars have a negative flank angle on the leading (driving) faces thereof and the dog teeth provided on the body have a corresponding negative flank angle so that the application of torque in the driving direction from the respective collar to the body will result in the collar being pulled towards the body.

Preferably, the trailing (reverse) flanks of the dog teeth on the collars have a positive flank angle so that rotation of each collar in the direction opposite to its normal drive direction will result in a cam force being generated between the reverse face of dog teeth on the collar and the dog teeth provided on the body to cam the collar away from the body.

Preferably, the collars are slideably mounted on their respective shafts and spring biased in the downhole direction.

The outside diameter of the thread on the main shaft is preferably less than the inside diameter of the thread on the body which is adapted to mate with the thread on the auxiliary shaft. With such an arrangement, the thread on the body which is adapted to mate with the main shaft can be located axially below the thread of the body adapted to mount with the thread on the auxiliary shaft. Alternatively, the threads on the body adapted to mate with the threads on the main shaft and auxiliary shaft can be superimposed and occupy the same axial zone of the body.

The above and further and features and advantages of the invention will be better understood from the following description of a preferred embodiment thereof, given by way of example only, reference being had to the accompanying drawings wherein.

Figure 9:
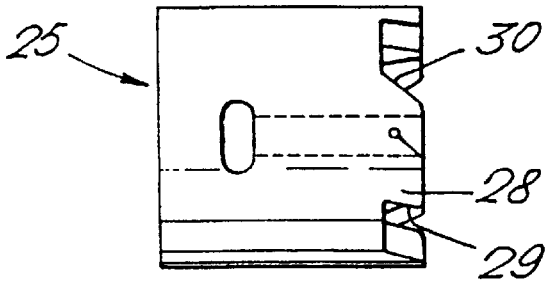
FIG. 9 is a plan view of the collar of the joint of FIG. 1.
Figure 10:
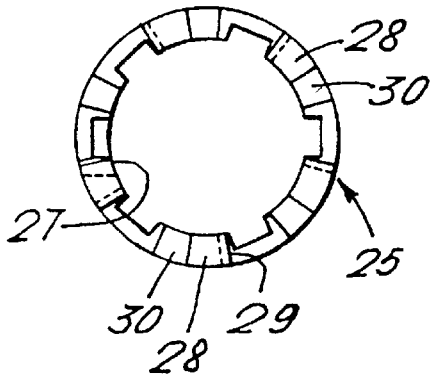
FIG. 10 is an end view of the collar of FIG. 9.
Figure 11:
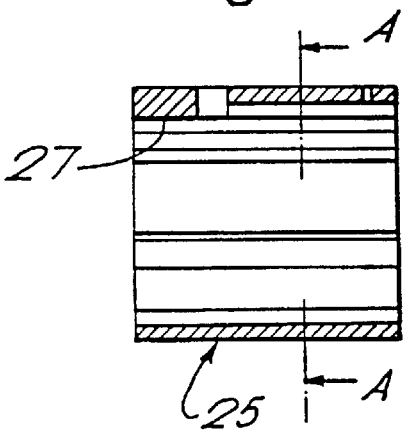
FIG. 11 is a longitudinal cross-section of the collar of FIG. 9.
Figure 12:
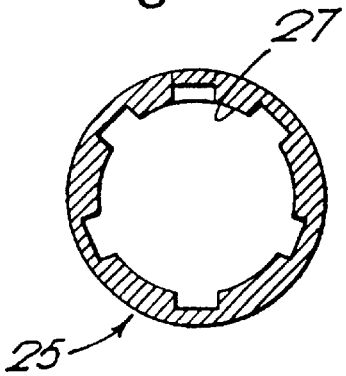
Figure 13:
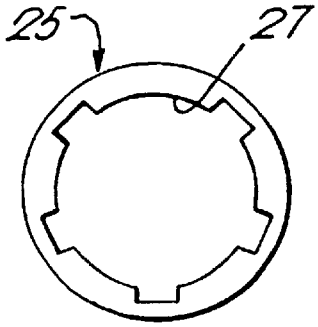

FIG. 12 a transverse cross-section of the collar of FIG. 9;

FIG. 13 is a view of the opposite end of the collar of FIG. 9; and

Figure 14:
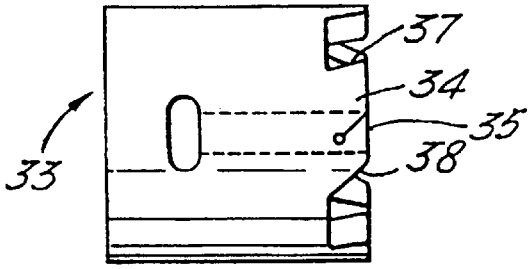

FIG. 14 a view corresponding to FIG. 9 showing the collar of an auxiliary shaft.

The following description is of an embodiment of the invention for use in a right hand string assembly, that is to say a string assembly in which the normal direction of rotation is clockwise when viewed from above. To this end, the joint illustrated in the drawings has right hand threaded connections at the top and bottom thereof, for mating with corresponding right hand threaded connections of a downhole assembly. Further, the tool is adapted to transmit torque applied in the clockwise direction when viewed from above, from above the joint to below the joint. Reverse rotation (i.e. in the anti-clockwise direction when viewed from above) will cause separation of the joint. It will be appreciated, however, that embodiments of the invention may be fabricated for use in left hand string assemblies—i.e. assemblies in which the normal direction of rotation is anti-clockwise when viewed from above. Such embodiments will have left hand threaded connections for connection to the other components of the downhole assembly.

Figure 1:
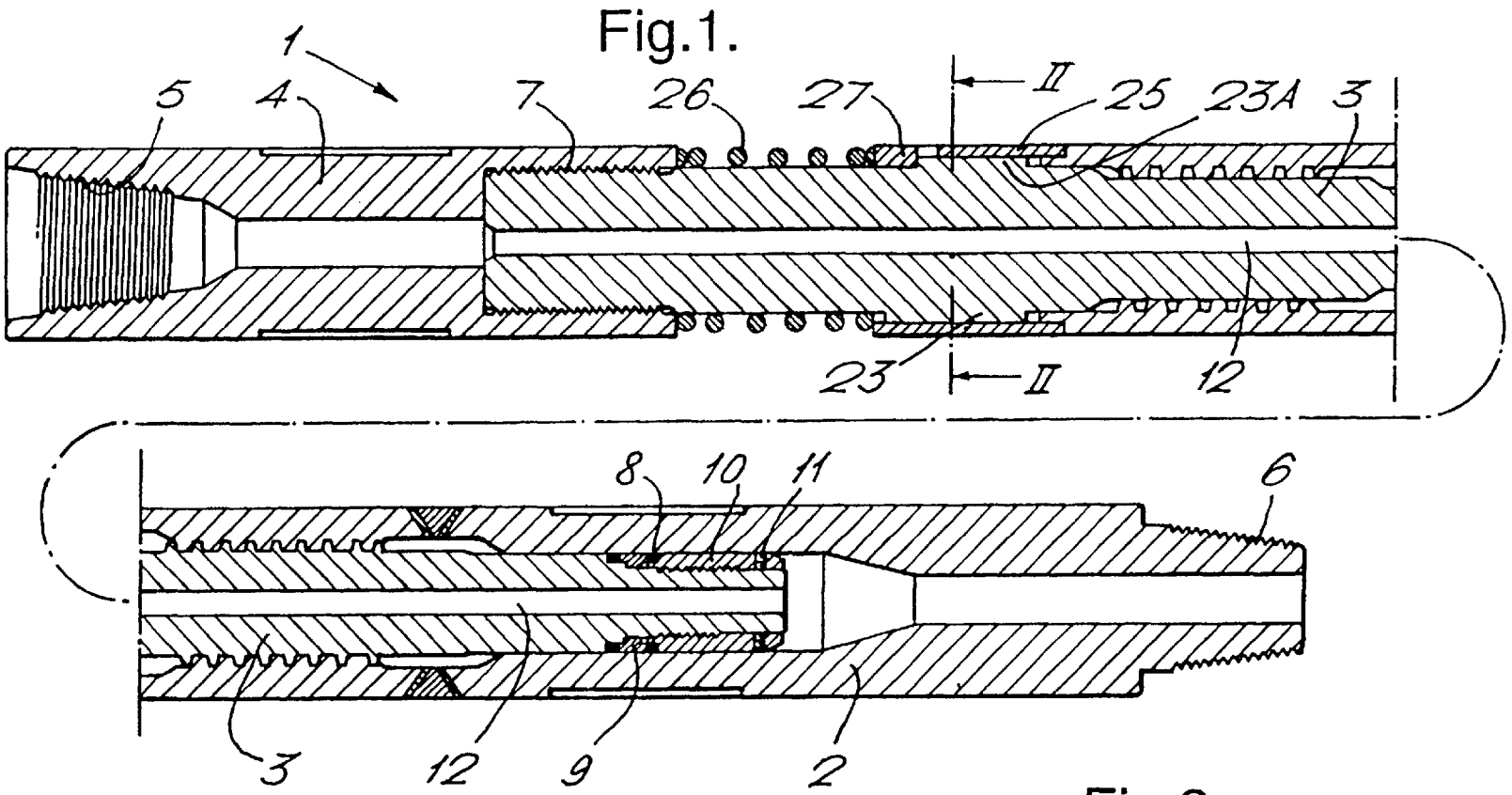
FIG. 1 is a schematic axial cross-sectional view of a preferred embodiment of the present invention.
Figure 2:
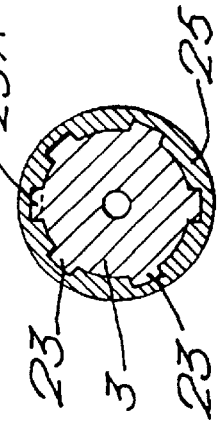
FIG. 2 is a cross-section on the line II—II of FIG. 1.

Referring firstly to FIG. 1, the safety joint 1 comprises a body 2, a main shaft 3 and a top sub 4. The top sub is provided with a standard API threaded socket 5 and the body is formed with an API threaded pin 6. Whilst the illustrated embodiment of the invention the socket 5 and pin 6 are formed with standard API threads it should be appreciated that any appropriate form of connection to adjacent components of a downhole assembly may be utilized.

The top sub 4 is connected to the main shaft 3 by an appropriate threaded connection 7. Suitable means, for example grub screws or the like, can be provided for locking the threaded connection 7 to avoid accidental release of the top sub 4 from the main shaft 3. It will be noted that because the top sub 4 is separate from the main shaft 3 the top connection 5 of the tool may readily be changed by substituting an alternative design of top sub 4 for that illustrated. In the illustrated embodiment of the invention wherein the tool is intended for use in a right hand string the threaded connection 7 is a right hand thread, for example a 6 TPI Acme right hand thread.

The distal end region of the main shaft 3 is provided with a seal 8 which is retained between a seal carriers 9 and a retaining nut 10. The retaining nut is screw threadedly engaged with the distal end of the main shaft and is retained in position by one or more grub screws 11. The seal 8 forms a fluid seal with the bore of the body thereat to prevent passage of fluid from the longitudinal bore 12 of the joint.

Figure 4:
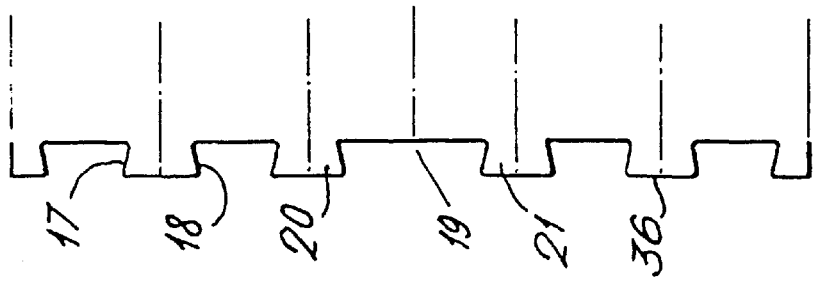
FIG. 4 is a development of the dog tooth profile of the body of FIG. 3.
Figure 3:
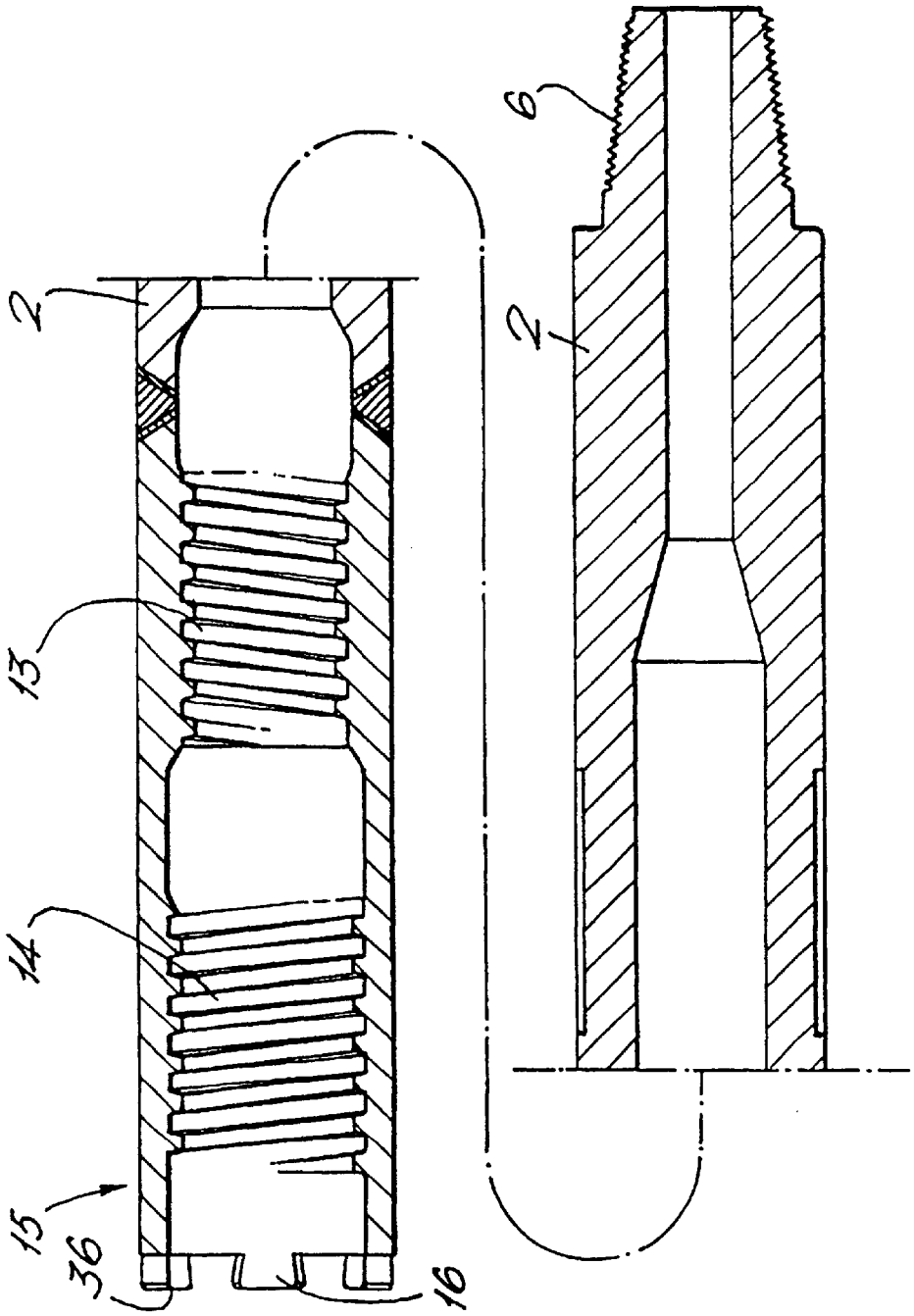
FIG. 3 is an enlarged cross-sectional view of the body of the joint of FIG. 1.

Referring now to FIG. 3, it will be seen that the body 2 is formed with a first female thread 13 and a second female thread 14. The threads 13,14 may be of any suitable form, e.g. acme or modified buttress threads. In the illustrated embodiment the threads 13,14 are stub acme threads and are of 15.24 mm (0.6 inches) pitch. The first thread 13 is a right hand thread and second thread 14 is a left hand thread. The upper end 15 of the body 2 is formed with a multiplicity of axially projecting dogs 16. A development of the profile of the end of the body is shown in FIG. 4. It will be noted that the opposite flanks 17,18 of each dog 16 each have a negative flank angle which, in the preferred embodiment, is 15°. It will also be noted that the dogs 16 are generally equally spaced save that the gap 19 between dogs 20 and 21 is substantially larger than the gap between any other pair of dogs 16.

Figure 5:
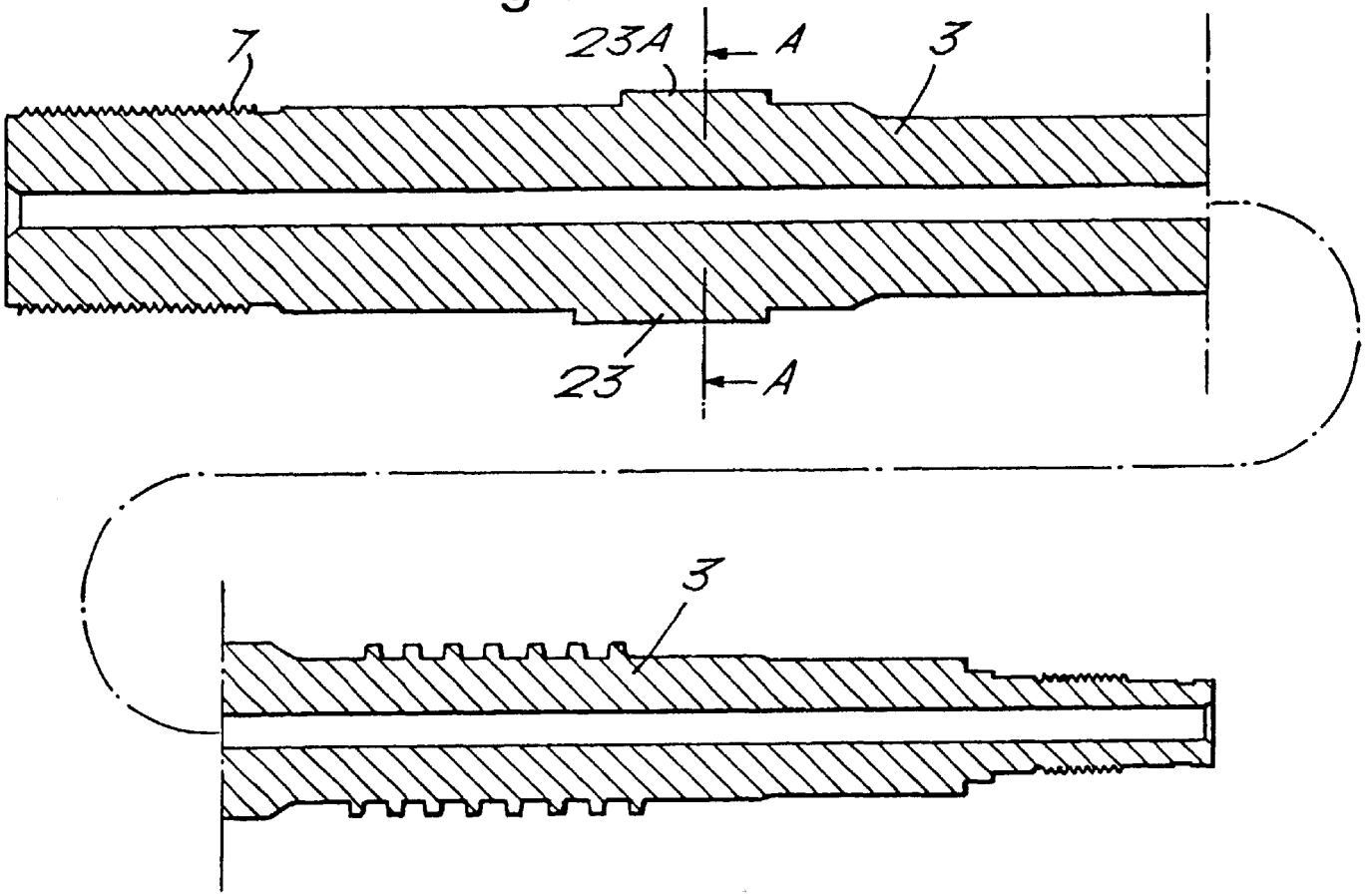
FIG. 5 is a longitudinal cross-sectional view on a larger scale of the shaft of the joint of FIG. 1.
Figure 6:
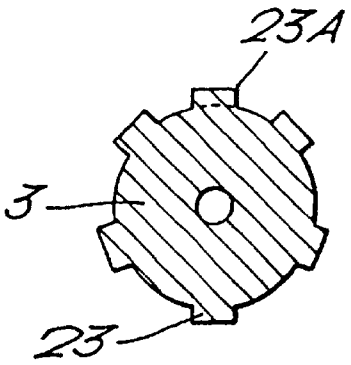
FIG. 6 is a cross-section on the line A—A of FIG. 5.
Figure 7:
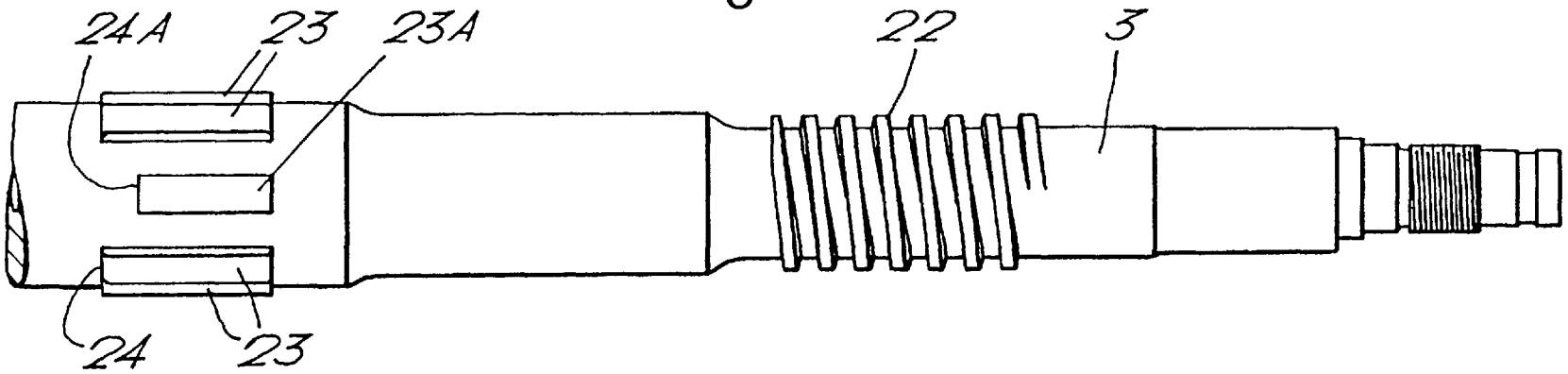
FIG. 7 is an elevational view of the left hand portion of the shaft of FIG. 5.

Referring now to FIGS. 5–7 the main shaft 3 is illustrated in detail. It will be noted that the main shaft is formed with a male thread 22 which, in use, mates with the thread 13 to permit axial loading to be transmitted in both axial directions between the main shaft 3 and the body 2. It will also be noted that the outside diameter of the thread 22 is less than the inside diameter of the thread 14 so that the thread 22 may pass through the thread 14 without interference. A multiplicity of splines 23 are formed on the main shaft. The splines 23 are generally of equal length save that one of the splines, 23A, is somewhat shorter than the other splines. The lower edges of the splines lie on a common radial plane so that the upper end 24A of the spline 23A is somewhat below the upper end 24 of the remaining splines 23.

Referring back to FIG. 1, a collar 25 is slideably mounted on the main shaft and is biassed in the downhole direction by a compression spring 26. The collar 25 includes a plurality of axially extending grooves to receive the splines 23,23A. The grooves to receive the splines 23 run the full length of the collar 25 whilst the groove to receive the spline 23A extends over only part of the length of the collar thereby providing an inwardly directed stop 27 which abuts the upper end 24A of the spline 23A to retain the collar on the shaft 3. The spring 26 is of such a size that even when the stop 27 is in engagement with the upper end 24A of the spline 23A the spring is to an extent compressed. Accordingly, there is a permanent downhole load applied to the collar by the spring 26.

The provision of a single short spline 23A and associated stop 27 also locates the collar relative to the main shaft in the rotational direction. As described below with reference to the collar 33 of FIG. 14, the relationship between the position of the collar dogs, the position of the body dogs and the position and pitch of the interengaging threads of the shaft and the body is important to correct operation of the invention. The use of a short spline 23 in association with a stop 27 ensures that the collar 25 is maintained at both the correct rotational and axial position relative to the main shaft prior to engagement with the end face of the body as described below with reference to the collar 33 of FIG. 14.

Referring now to FIGS. 9–13 the collar 25 is illustrated in detail. The lower end of the collar is formed with a multiplicity of axially extending dogs 28 which are sized to be received between the dogs 16 of the body 3. Each dog 28 includes a leading face 29 which has a negative flank angle corresponding to that of the faces 17,18 of the dogs of the body. Accordingly, with the components in the assembled condition illustrated in FIG. 1 torque applied to the sub 4 in the usual string rotational direction will be transferred by the splines 23,23A to the collar 25 and by the dogs 28 to the dogs 16 of the body. The mating negative flank angles of the interengaging dogs will tend to draw the collar 25 towards the body 2 in response to torque loading and prevent slippage of the dogs relative to each other. Accordingly, the interengaging threads 13,22 are not required to transmit any torque during operation of the tool.

Reverse rotation of the upper part of the string will cause reverse rotation of the top sub 4, the main shaft 3 and, via the splines 23,23A of the collar 25. The reverse flank 30 of each collar dog 28 has a positive flank angle, typically of 45°. The reverse rotation of the string will cause the rear flanks 30 to engage the dogs 16 of the body and the slope of the reverse flanks will act as a cam surface to produce axial force on the collar biasing the collar up-hole. This force will causes the collar 25 to slide upwardly on the splines 23,23A, compressing the spring 26 and thereby permitting disengagement of the collar dog 28 from the dogs 16 of the body and permitting the threads 13,22 to disengage thereby allowing the joint to separate and permitting removal of the upper part of the string including the sub 4, main shaft 3, and all components mounted thereon. The body 2 will remain connected to the portion of the assembly which remains in the well.

Figure 8:
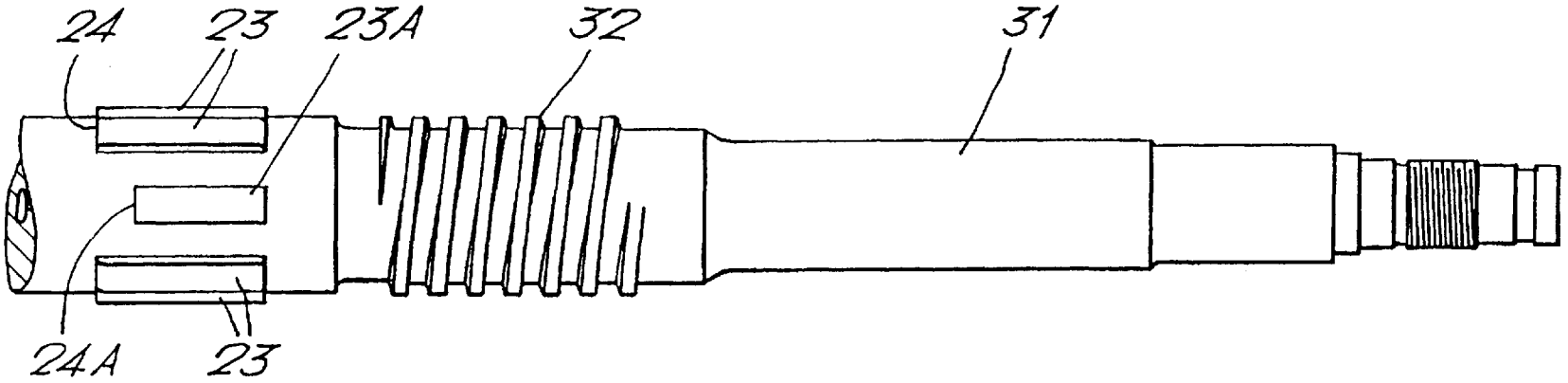
FIG. 8 is a view corresponding to FIG. 7 showing a portion of an auxiliary shaft.

If it is designed to apply a reverse torque to the portion of the assembly remaining in the well either in an attempt to free the assembly or to recover further components of the assembly, a new string is made up of reverse threaded pipe with the auxiliary shaft 31 of FIG. 8 at the lower extremity thereof. This string is run into the well until the distal end of the auxiliary shaft 31 enters the body 2. The shaft is then further lowered and rotated to engage the threads 32 of the auxiliary shaft with the threads 14 of the body.

The auxiliary shaft 8 is fitted with a collar 33 as shown in FIG. 14. The collar 33 is substantially identical to the collar 25 of FIGS. 9–13 save that the dogs 34 of the collar 33 are reversed relative to the dogs 28 of the collar 25.

As the string containing the auxiliary shaft 31 is rotated to engage the threads 32 of the auxiliary shaft with the threads 14 of the body the leading face 35 defined by the free ends of the dogs 34 will eventually engage the end face 36 of the body 3 which is defined by the free ends of the dogs 16 provided on the body.

It will be noted that the collar 33 includes one dog 34 which is substantially wider than the remaining dogs 34 and is wider than the normal gap between the dogs 16 of the body 2. The wide dog 34 is sized to be received within the space 19 provided between the dogs 20 and 21 of the body 2. However, the angular and axial relationship between the wide dog 34, the start of the thread 32, the start of the thread 14 and the position of the end face 36 is such that at the moment when the end face 35 of the collar 33 comes into contact with the end face 36 of the body 2 the wide dog 34 will be slightly beyond, in the direction of rotation, the wide gap 19 with which it will eventually mate. Accordingly, continued rotation of the auxiliary string will cause the end face of the wide dog 34 to ride along the end face 36 of the body 2. The already partial engagement of the threads 14 and 32 will cause the auxiliary shaft 31 to continue its downward movement into the body 2 and as a result the collar 33 will move upwardly relative to the auxiliary shaft 31. Such upward movement will be accommodated by the compression of the compression spring 26 associated with the auxiliary collar 33. As rotation of the auxiliary shaft continues the wide dog 34 will eventually come into register with the wide space 19 and at this point the spring 26 will urge the collar downwardly to engage the dogs 34 of the collar 33 with the dogs 16 of the body 2.

The pitch of the threads 14,32 is such that by the time the wide dog 34 comes into register with the space 19 the clearance between the stop 27 of the auxiliary collar 33 and the end face of the spline 23A of the auxiliary shaft 31 will be sufficient to allow the collar to move to bring the collar dogs and body dogs into full engagement. Continued rotation of the string in the reverse direction will then allow the torque to be applied by the leading faces 37 of the dogs 34 to the corresponding faces of the dogs 16 of the body 2.

It will be noted that if the application of reverse torque to the portion of the assembly remaining in the well is unsuccessful the auxiliary shaft and the reverse string can readily be disengaged from the body 2 by resuming the original direction of rotation of the string and thereby causing the reverse flanks 38 of the dogs of the collar 33 to cam the collar 33 upwardly in the manner described previously in relation to the collar 25. Normally, however, the reverse rotation will at the very least break the joint between the body 2 and the next adjacent component in the remaining portion of the assembly, thereby allowing the body 2 to be recovered.

It is envisaged that a particularly appropriate use for the above described safety joint is as part of a fishing string. Such strings are normally run into a well on reverse threaded pipe—i.e. pipe which is rotated in the opposite direction to that of standard drill pipe. Under these circumstances, if the fishing operation is unsuccessful and the fishing tool becomes stuck in the well the safety joint as originally run in can be separated by backing off the fishing string to disengage the threads 13,22 as described above. The auxiliary string can then be made up using the auxiliary shaft 31 and standard drill pipe which will, in any event, be present on the rig. The auxiliary string can then be run in and used to apply torque in the standard rotational direction to the fishing assembly. If this operation is unsuccessful in freeing the fishing tool it will at least result in recovery of the body 2 as described above.

As an alternative to using a reverse threaded string to effect reverse rotation of the downhole assembly it will be understood by those skilled in the art that a reversing tool may be incorporated at the bottom of a conventional drill string and immediately above the assembly to which reverse rotation is to be applied. Such reversing tools, such as the type available from Houston Engineering, are activatable to produce on a rotation of an output shaft in the reverse direction to the rotation of a drill string to which they are connected. The safety joint of the present invention may be used in downhole assemblies of this type.

The invention as described above is susceptible to a number of variations within the scope thereof. In particular, whilst in the preferred embodiment of the invention the dog clutch arrangement is used for transferring torque from the upper part of the tool to the lower part thereof, other arrangements are possible and indeed by appropriate choice of threads and abutment surfaces a simplified embodiment of the invention can be made in which torque is transferred to the body via the threads of the main shaft and auxiliary shaft respectively. Also, whilst the use of axially spaced apart threads on the body 2 is preferred as the means of coupling with the main shaft and the auxiliary shaft respectively for the purposes of transferring axial load, other arrangements are possible. For example, one or other of the threads 13,14 can be replaced by another appropriate interengaging configuration—for example a J slot arrangement adapted to mate with pins provided on the main shaft or auxiliary shaft. Alternatively, the threads 13,14 may be superimposed on each and may accordingly be of the same diameter and at the same axial position within the body 2.

What is claimed is:

1. A safety joint for use in a downhole assembly to permit separation of the assembly at the location of the joint, the safety joint comprising:

a body;

means for securing the body to part of the assembly;

a main shaft;

means for securing the main shaft to the remainder of the assembly; and main interconnecting means for interconnecting the main shaft and the body to transfer axial loading therebetween and to transmit torque from the shaft to the body in one direction of rotation of the shaft, the interconnecting means being releasable in response to rotation of the shaft in the opposite direction of rotation to release the shaft from the body;

the safety joint being characterized in that the auxiliary interconnecting means is provided on the body for interconnecting the body to an auxiliary shaft, after removal of the main shaft from the body, to transfer axial loading between the auxiliary shaft and the body and to transfer torque from the auxiliary shaft to the body in the opposite direction of rotation, and wherein the main interconnecting means comprises a first screw thread on the body for engagement by a corresponding screw thread on the main shaft and a main dog clutch for transmitting torque in one direction of rotation from the main shaft to the body.

2. A safety joint as claimed in claim 1, wherein the auxiliary interconnecting means is releasable in response to rotation of the auxiliary shaft in the one direction of rotation.

3. A safety joint as claimed in claim 1, wherein the main dog clutch is formed by dog teeth provided on the body and dog teeth provided on a collar secured to the main shaft.

4. A safety joint as claimed in claim 3, wherein the auxiliary interconnecting means comprises a second screw thread on the body for engaging a corresponding screw thread on the auxiliary shaft, and an auxiliary dog clutch for transmitting torque from the auxiliary shaft to the body in the said opposite direction of rotation.

5. A safety joint as claimed in claim 4, wherein the outside diameter of the thread on the main shaft is less than the inside diameter of the thread on the body which is adapted to mate with the thread on the auxiliary shaft.

6. A safety joint as claimed in claim 4, wherein the auxiliary dog clutch is formed by the dog teeth provided on the body and the dog teeth are provided on an auxiliary collar secured to the auxiliary shaft.

7. A safety joint as claimed in claim 4, wherein the threads on the body adapted to mate with the threads on the main shaft and auxiliary shaft are superimposed and occupy the same axial zone of the body,

8. A safety joint as claimed in claim 3, wherein the dog teeth provided on the or each collar have a negative flank angle on the leading (driving) faces thereof and the dog teeth provided on the body have a corresponding negative flank angle so that the application of torque in the driving direction from the or each collar to the body will result in the or each collar being pulled towards the body.

9. A safety joint as claimed in claim 8, wherein the trailing (reverse) flanks of the dog teeth on the or each collar have a positive flank angle so that rotation of the or each collar in the direction opposite to its normal drive direction will result in a cam force being generated between the reverse face of the dog teeth on the or each collar and the dog teeth provided on the body cam the or each collar away from the body.

10. a safety joint as claimed in claim 3, wherein the or each collar is slideably mounted on its shaft and spring biased in the downhole direction.

11. A safety joint as claimed in claim 8, wherein the threads on the body adapted to mate with the threads on the main shaft and auxiliary shaft are superimposed and occupy the same axial zone of the body.

12. A safety joint as claimed in claim 11, wherein the auxiliary interconnecting means is releasable in response to rotation of the auxiliary shaft in the said one direction of rotation.

13. A safety joint as claimed in claim 11, wherein the main interconneting means comprises a first screw thread on the body for engagement by a corresponding screw thread on the main shaft and a main dog clutch for transmitting torque in the one direction of rotation from the main shaft of the body.

14. A safety joint as claimed in claim 13, wherein dog teeth of the dog clutch of the main interconnecting means are provided on a collar secured to the main shaft.

15. A safety joint as claimed in claim 14, wherein the auxiliary interconnecting means comprises a second screw thread on the body for engaging a corresponding screw thread on the auxiliary shaft.

16. A safety joint as claimed in claim 15, wherein the dog teeth of the dog clutch of the auxiliary interconnecting means are provided on an auxiliary collar secured to the auxiliary shaft.

17. A safety joint as claimed in claim 15, wherein the outside diameter of the thread on the main shaft is less than the inside diameter of the thread on the body which is adapted to mate with the thread on the auxiliary shaft.

18. A safety joint as claimed in claim 14, wherein the dog teeth provided on the or each collar have a negative flank angle on the leading (driving) faces thereof and the dog teeth provided on the body have a corresponding negative flank angle so that the application of torque in the driving direction from the or each collar to the body will result in the or each collar being pulled towards the body.

19. A safety joint as claimed in claim 18, wherein the trailing (reverse) flanks of the dog teeth on the or each collar have a positive flank angle so that rotation of the or each collar in the direction opposite to its normal drive direction will result in a cam force being generated between the reverse face of the dog teeth on the or each collar and the dog teeth provided on the body to cam the or each collar away from the body.

20. A safety joint as claimed in claim 16, wherein the or each collar is slideably mounted on its shaft and spring biased in the downhole direction.

21. A safety joint as claimed in claim 15, wherein the threads on the body adapted to mate with the threads on the main shaft and auxiliary shaft are superimposed and occupy the same axial zone of the body.

* * * * *